US010612242B1

(12) United States Patent
Cox, Jr. et al.

(10) Patent No.: US 10,612,242 B1
(45) Date of Patent: Apr. 7, 2020

(54) SNOWGUARD

(71) Applicant: Advantage Plastics, Inc., Mountain City, TN (US)

(72) Inventors: Timothy A. Cox, Jr., Mountain City, TN (US); Timothy A. Cox, Trade, TN (US); Tyran A. Cox, Mountain City, TN (US)

(73) Assignee: ADVANTAGE PLASTICS, INC., Mountain City, TN (US)

( * ) Notice: Subject to any disclaimer, the term of this patent is extended or adjusted under 35 U.S.C. 154(b) by 0 days.

(21) Appl. No.: 16/374,803

(22) Filed: Apr. 4, 2019

(51) Int. Cl.
*E04D 13/00* (2006.01)
*E04D 13/10* (2006.01)

(52) U.S. Cl.
CPC ..... *E04D 13/10* (2013.01)

(58) Field of Classification Search
CPC ..... E04D 13/10; E04D 13/103; E04D 13/106
USPC ..... 52/24, 26, 57, 82
See application file for complete search history.

(56) References Cited

U.S. PATENT DOCUMENTS 3,296,750 A 1/1967 Zaleski
4,141,182 A * 2/1979 McMullen ..... E04D 13/10 52/24
D314,506 S * 2/1991 McMullen ..... D8/499
5,349,791 A * 9/1994 Zaleski ..... E04D 13/10 52/24
5,664,374 A * 9/1997 Lee ..... E04D 13/10 52/24
5,901,507 A 5/1999 Smeja et al.
6,266,929 B1 * 7/2001 Cline ..... E04D 13/10 52/24
D512,303 S * 12/2005 Prichard, Jr. ..... D8/499
6,996,938 B1 * 2/2006 Mullane ..... E04D 13/10 52/24
D553,972 S * 10/2007 Prichard, Jr. ..... D8/499
D617,181 S * 6/2010 McMullen ..... D8/499
7,997,032 B2 * 8/2011 Riley ..... E04D 13/10 52/18
D689,359 S * 9/2013 Fisher ..... D8/499
8,763,311 B2 * 7/2014 Lupski ..... E04D 13/10 52/26

OTHER PUBLICATIONS

UV Clear 1.5 in Mini Snow Guard with Perfect Seal Gasket, The Home Depot (last accessed Feb. 13, 2019).

* cited by examiner

*Primary Examiner* — Chi Q Nguyen
(74) *Attorney, Agent, or Firm* — Shane Cortesi

(57) ABSTRACT

A roof snow guard with a gasket on the bottom is described. In some embodiments, the snowguard includes a base with a vertical faceplate extending upward from the base and one or more side braces extending between the base and vertical faceplate. The base may include a fastener aperture(s) along with an external rib located on the base top. The gasket may lock to the base bottom via fastener(s) extending through the base and gasket, as well as one or more protrusions located on the base bottom that engage the gasket. The base bottom may further include conical protrusion(s) extending below the gasket that engage the roof.

21 Claims, 8 Drawing Sheets

SNOWGUARD

BACKGROUND

Technical Field

The present invention relates to roof accessories, more particularly snow guards.

Background of the Invention

Snow guards are known in the art.

Examples of previous snow guards include, for example, those described in U.S. Pat. Nos. 5,901,507 and 3,296,750, the entire contents of which are incorporated herein by reference.

In addition, Advantage Plastics Inc. (Mountain City, Tenn.) currently sells snow guards that include gaskets through various retailers and the website https://snowguard-direct.com/products/ (last accessed Feb. 13, 2019).

BRIEF SUMMARY

The present disclosure provides snowguard-gasket systems as described herein. In some embodiments, the systems are especially designed for metal roofs. Generally speaking, the system may include a snowguard having a snowguard base and a faceplate that is configured to hold snow, a gasket located below the snowguard base and above the roof, and one or more of the following features: 1) one or more protrusions (preferably on the base) that secure the gasket to the base; 2) an external rib located on the base top and adjacent to a base fastener aperture; and 3) a conical protrusion(s) located on the base bottom that extend beyond the gasket into the roof.

More particularly, in some embodiments, the present disclosure provides a method of attaching a snowguard to a roof of a building. The method may include providing a snowguard-gasket system that may include a snowguard that includes a snowguard bottom, a snowguard top, a snowguard height extending from the snowguard bottom to the snowguard top, a snowguard front, a snowguard rear, a snowguard length extending from the snowguard front to the snowguard rear and generally perpendicular to the snowguard height, a snowguard left side, a snowguard right side, and a snowguard width extending from the snowguard left side to the snowguard right side and generally perpendicular to the snowguard height and snowguard length. The snowguard may be comprised of a horizontal snowguard base comprising a base top, a base bottom located at the snowguard bottom, a base height extending from the base top to the base bottom and generally parallel to the snowguard height, a base front, a base rear, a base length extending from the base front to the base rear and generally parallel to the snowguard length, a base left side, a base right side, and a base width extending from the base left side to the base right side. The base may further include a base fastener aperture extending through the base. Optionally, the system further includes a vertical face plate that may extend upward from the snowguard base at an angle of approximately 90 degrees and may include a face plate bottom, a face plate top, a face plate height extending from the face plate top to the face plate bottom and generally parallel to the snowguard height, a face plate front configured to block snow, a face plate rear, a face plate length extending from the face plate front to the face plate rear and generally parallel to the snowguard length, a face plate left side, a face plate right side, and a face plate width extending from the face plate left side to the face plate right side and generally parallel to the snowguard width. The system may further include a gasket attached to the base bottom and comprising a gasket top confronting the base bottom, a gasket bottom configured to confront the roof of the building, a gasket height generally parallel to the snowguard height, a gasket front, a gasket rear, a gasket length extending from the gasket front to the gasket rear and generally parallel to the snowguard length, a gasket left side, a gasket right side, a gasket width extending from the gasket left side to the gasket right side generally parallel to the snowguard width, wherein the gasket further comprises a gasket fastener aperture aligned with the base aperture and extending through the gasket. Optionally, the gasket is comprised of a flexible material. Optionally, at least one of the base and the gasket may further include at least one protrusion securing the gasket to the base bottom. Optionally, the method further includes placing the gasket bottom against the roof of the building. Optionally, the method further includes securing the snowguard-gasket system to the roof by positioning a fastener so that it extends through the base fastener aperture, through the gasket fastener, and into the roof. Optionally, the base comprises at least one protrusion extending into the gasket. Optionally, the base bottom further comprises a recess/groove, wherein the gasket top further comprises a raised lip seated inside the recess/groove, and further wherein the base bottom further comprises a plurality of protrusions extending laterally into the recess/groove and into/engaging the raised lip to secure the gasket to the base. Optionally, the gasket further comprises a cavity, the raised lip of the gasket forms a substantially closed perimeter bordering the cavity, the cavity comprises a gasket rib extending across the cavity from one portion of the raised lip to another portion of the raised lip, and the gasket fastener aperture is located in the gasket rib. Optionally, the gasket rib is an X-shaped pattern. Optionally, the recess/groove and raised lip are generally rectangular in shape. Optionally, some of the plurality of protrusions extend laterally into the recess/groove generally parallel to the base width and some of the plurality of protrusions extend laterally into the recess/groove generally parallel to the base length. Optionally, the plurality of protrusions are generally semi-circular in shape. Optionally, the base top further comprises an external rib located adjacent to the base fastener aperture. Optionally, the fastener confronts the external rib at least after Step C). Optionally, the external rib is an X-shaped pattern. Optionally, the base is generally rectangular in shape and comprises four rounded corners and the X-shaped pattern comprises rounded ends. Optionally, the base front comprises an indendation located between two rounded corners. Optionally, the snowguard further comprises a brace extending from the base to the face plate. Optionally, the snowguard further comprises two braces extending from the base to the face plate, wherein the braces are separated by a space, and further wherein the fastener aperture is located in the space. Optionally, the base top further comprises an external rib located adjacent to the base fastener aperture, and further wherein the external rib is located in the space. Optionally, the external rib is an X-shaped pattern. Optionally, the braces are generally triangular in shape. Optionally, the braces comprise a brace height generally parallel to the snowguard height, wherein the braces comprise a brace length generally parallel to the snowguard length, wherein one brace is located adjacent to the base left side and another brace is located adjacent to the base right side. Optionally, the base bottom further comprises a generally conical protrusion extending through the gasket into the roof. Optionally, the base bottom further comprises two generally conical protrusions located on opposite sides of the base gasket fastener extending through the gasket into the roof. Optionally, the generally conical protrusion extends into the roof a distance of about 0.001 inches to about 0.1 inches. Optionally, the generally conical protrusion extends through a gasket protrusion aperture in the gasket. Optionally, the generally conical protrusion comprises an apex engaging the roof. Optionally, the face plate front is generally flat. Optionally, the method further includes the step of resting snow against the face plate front. Optionally, the snowguard is injection-molded plastic. Optionally, the gasket is comprised of low durometer PVC or silicone.

BRIEF DESCRIPTION OF THE DRAWINGS

in FIG. 11, particular emphasis has been made to show the optional transparent nature of the snow-guard gasket system.

DETAILED DESCRIPTION

Figure 1:
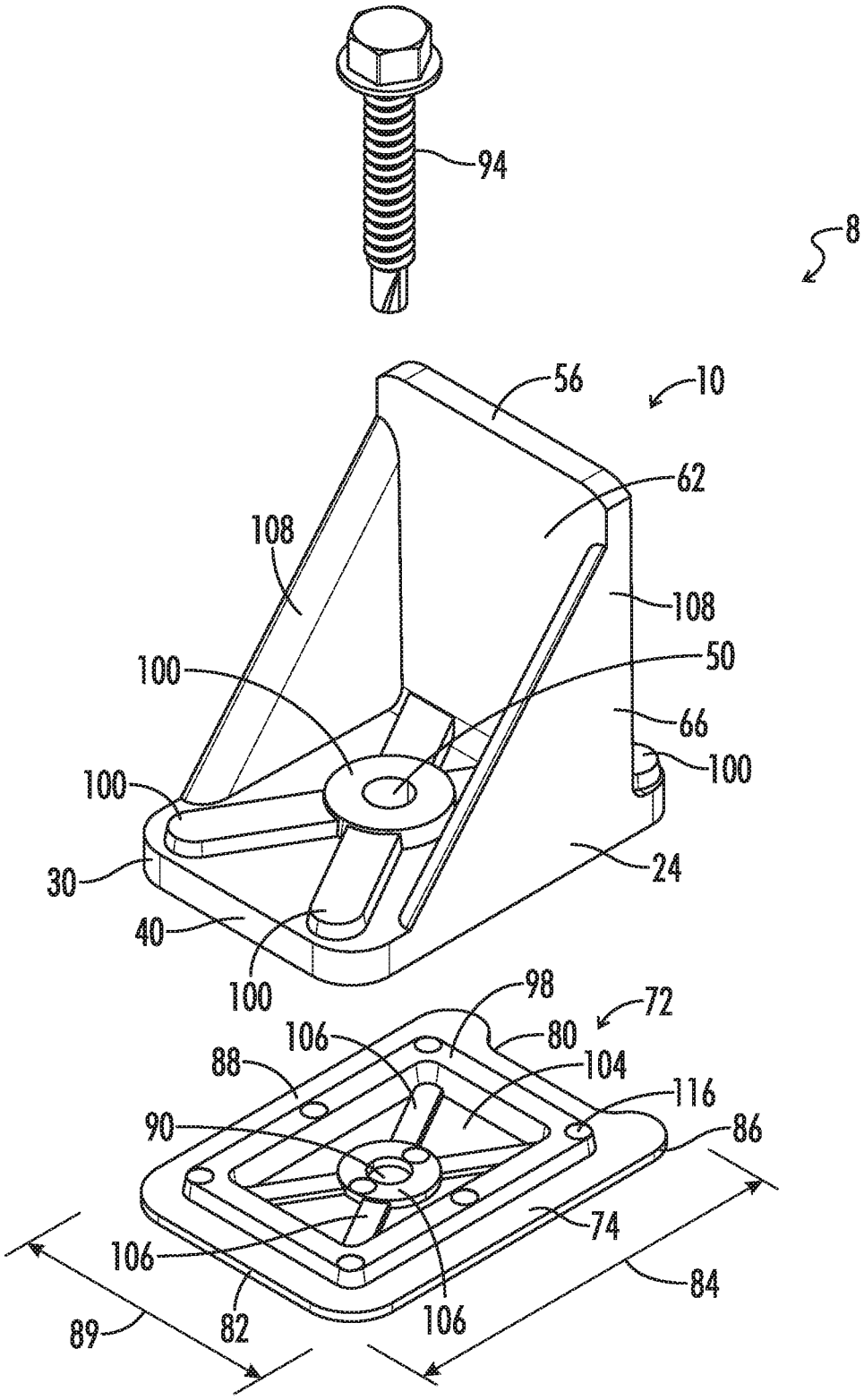
FIG. 1 illustrates a rear exploded perspective view of one embodiment of the snowguard-gasket system of the present invention.

With reference to FIGS. 1-11, the present invention provides a snowguard-gasket system generally designated by the numeral 8. In the drawings, not all reference numbers are included in each drawing for the sake of clarity. It will be understood that the above drawings are CAD drawings drawn to scale.

Referring further to FIGS. 1-11, the snowguard-gasket system 8 may include a snowguard 10 and a gasket 72 located below the snowguard.

The snowguard 10 may include a snowguard bottom 12, a snowguard top 14, a snowguard height 16 extending from the snowguard bottom 12 to the snowguard top 14, a snowguard front 18, a snowguard rear 20, a snowguard length 22 extending from the snowguard front 18 to the snowguard rear 20 and generally perpendicular to the snowguard height 16, a snowguard left side 24, a snowguard right side 26, and a snowguard width 28 extending from the snowguard left side 24 to the snowguard right side 26. The snowguard 10 may be any suitable shape, include generally rectangular or ovular for example. The word "side" is not intended to require that the snowguard 10 be rectangular.

As shown in FIGS. 1-11, the snowguard 10 may include a horizontal snowguard base 30 comprising a base top 32, a base bottom 34 located at the snowguard bottom 12, a base height 36 extending from the base top 32 to the base bottom 34 and generally parallel to the snowguard height 16, a base front 38, a base rear 40, a base length 42 extending from the base front 38 to the base rear 40 and generally parallel to the snowguard length 22, a base left side 44, a base right side 46, and a base width 48 extending from the base left side 44 to the base right side 46. The base 30 may further include a base fastener aperture 50 extending through the base 30 optionally generally parallel to the base height 36. The snowguard 10 may further include a vertical face plate 52 extending upward from the snowguard base 30 at an angle of approximately 90 degrees and comprising a face plate bottom 54, a face plate top 56, a face plate height 58 extending from the face plate top 56 to the face plate bottom 54 and generally parallel to the snowguard height 16, a face plate front 60 configured to block snow, a face plate rear 62, a face plate length 64 extending from the face plate front 60 to the face plate rear 62, a face plate left side 66, a face plate right side 68, and a face plate width 70 extending from the face plate left side 66 to the face plate right side 68 and generally parallel to the snowguard width 28.

The gasket 72 may be attached to the base bottom 34 and may include a gasket top 74 confronting the base bottom 34, a gasket bottom 76 configured to confront a roof 78 of a building, a gasket height 77 generally parallel to the snowguard height 16, a gasket front 80, a gasket rear 82, a gasket length 84 extending from the gasket front 80 to the gasket rear 82 and generally parallel to the snowguard length 22, a gasket left side 86, a gasket right side 88, a gasket width 89 extending from the gasket left side 86 to the gasket right side 88 generally parallel to the snowguard width 28. The gasket 72 may further include a gasket fastener aperture 90 aligned with the base aperture 50 and extending through the gasket 72 (optionally generally parallel to the gasket height 77). Whereas, the snowguard 10 is preferably rigid, the gasket 72 is preferably comprised of a flexible material to create a seal against the roof 78 and prevent damage by moisture.

Optionally, at least one of the base 30 and the gasket 72 comprise at least one protrusion securing the gasket 72 to the base bottom 34.

To secure the snowguard-gasket system 8 to the roof 78, the user may place the gasket bottom 76 against the roof 78 of the building and then secure the snowguard-gasket system 8 to the roof 78 by positioning a fastener 94 so that it extends through the base fastener aperture 50, through the gasket fastener 90, and into the roof 78. Optionally, the fastener 94 is generally parallel to the gasket height 77 and base height 36.

Figure 7:
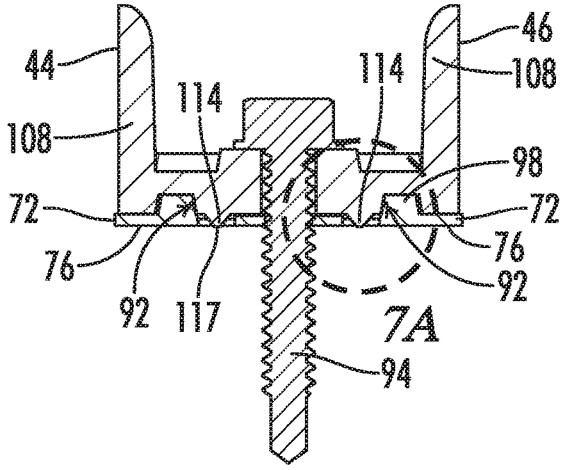
FIG. 7 illustrates a sectional view of the snowguard-gasket system of FIG. 1 taken along line 7-7 of FIG. 5.
Figure 7A:
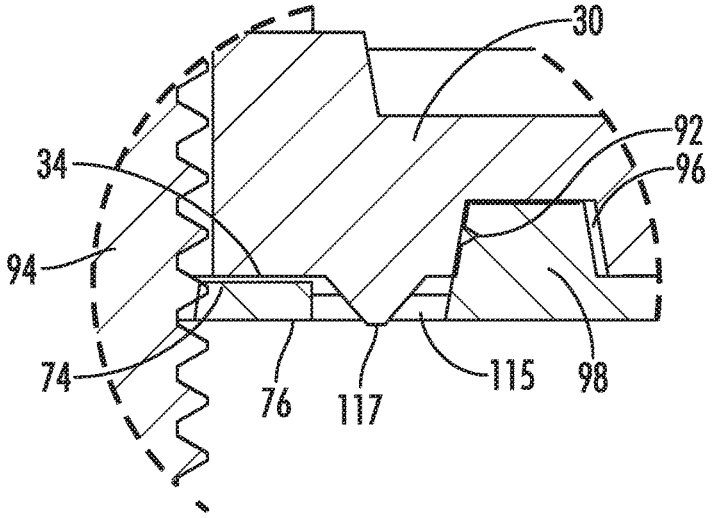
FIG. 7A illustrates a closeup view of the circled area labelled 7A in FIG. 7.
Figure 8:
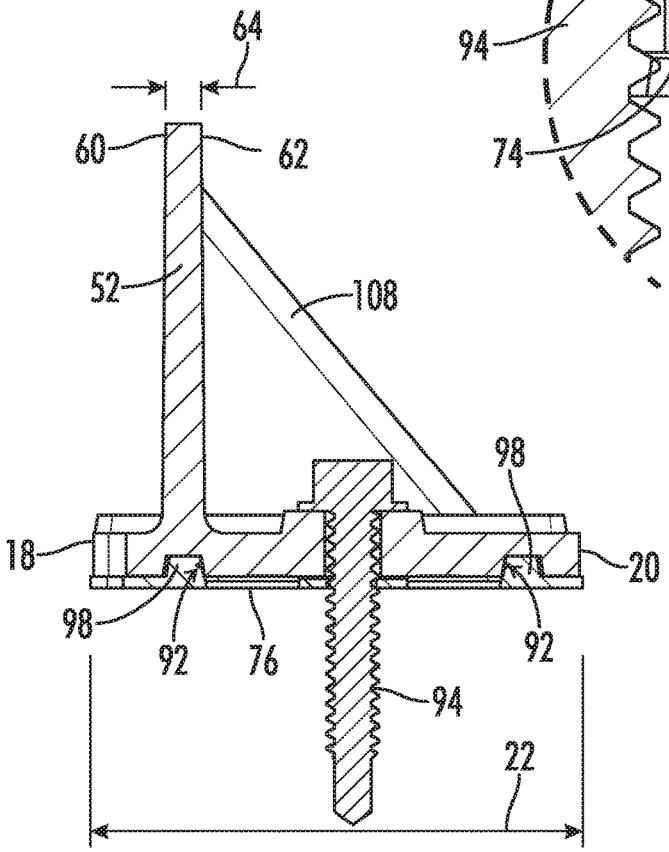
FIG. 8 illustrates a sectional view of the snowguard-gasket system of FIG. 1 taken along line 8-8 of FIG. 6.
Figure 9:
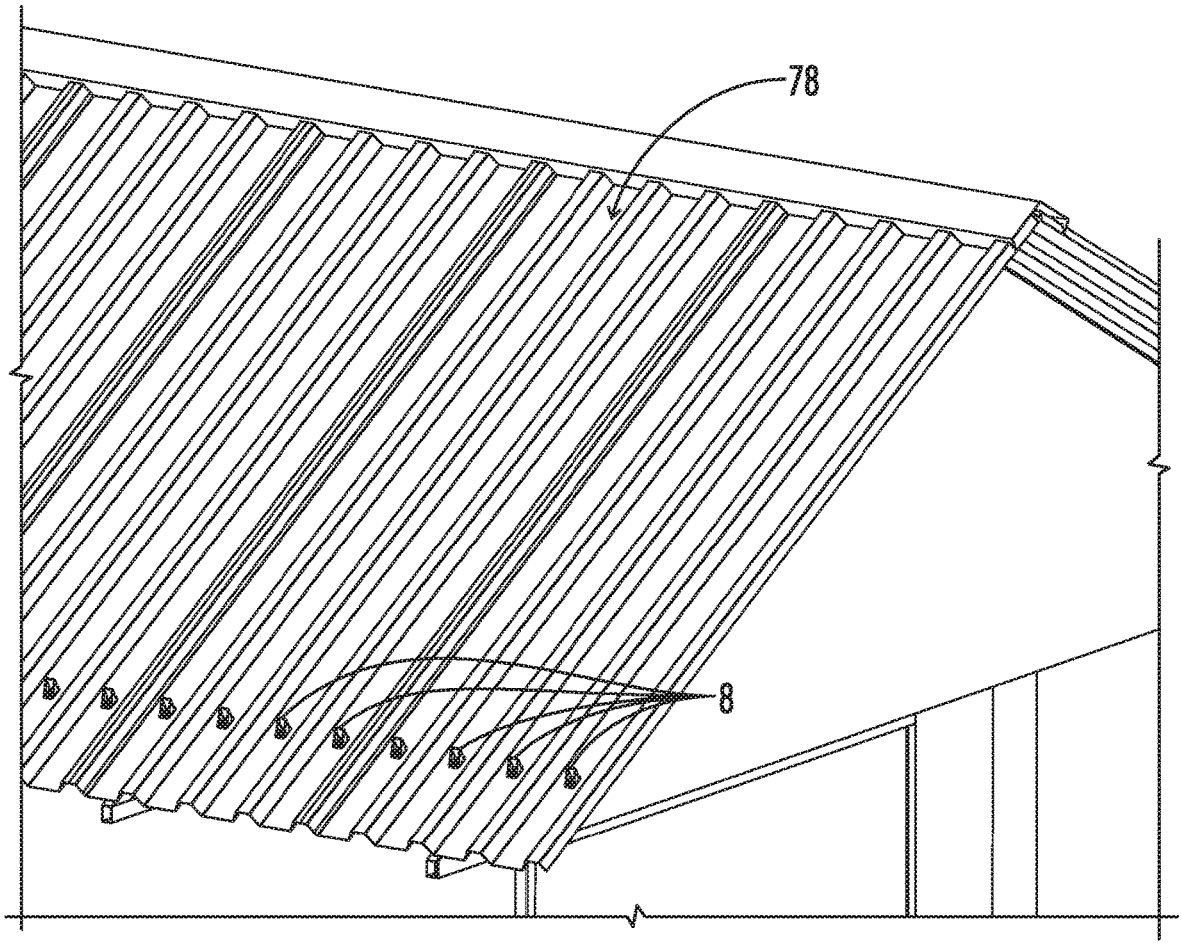
FIG. 9 illustrates a rear perspective view of the snowguard gasket system of FIG. 1 located on a roof.
Figure 10:
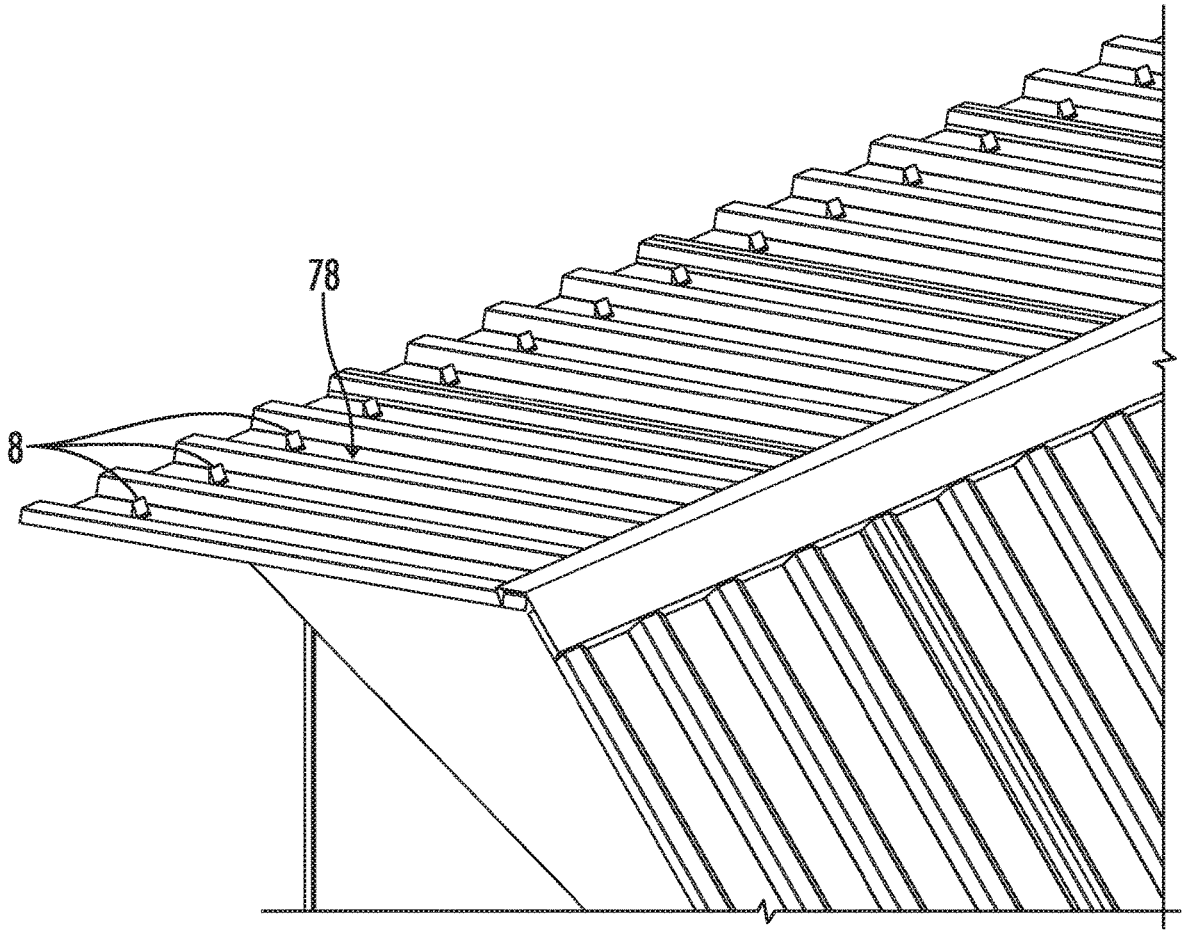
FIG. 10 illustrates a front perspective view of the snowguard gasket system of FIG. 1 located on a roof.
Figure 11:
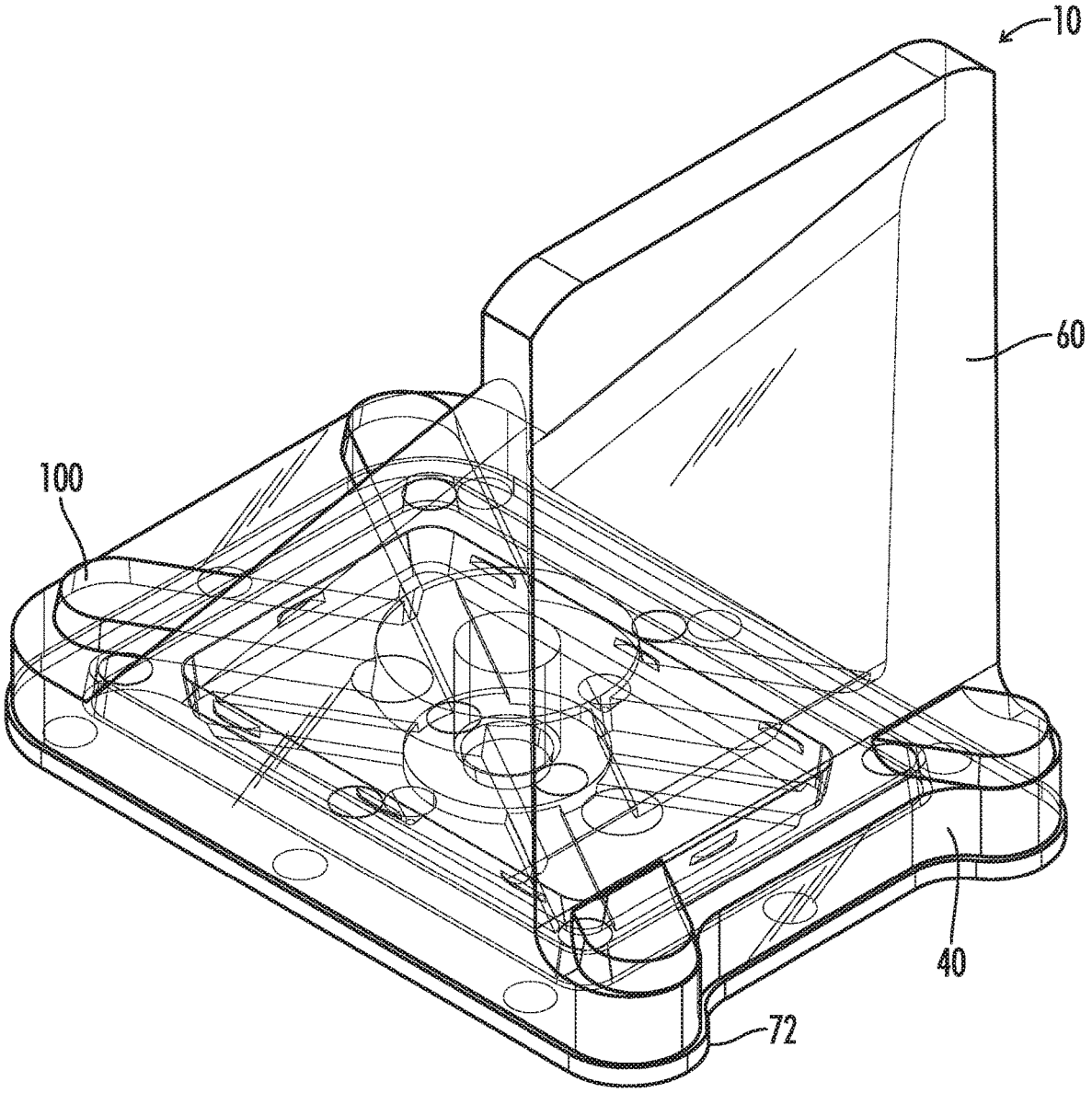
FIG. 11 illustrates a front perspective view of the snowguard gasket system of FIG. 1.

Optionally, the base 30 comprises at least one protrusion 92 extending into/biting into and temporarily deforming/deflecting (preferably a very subtle deformation) a portion of the gasket 72, as best seen in FIG. 7A. Optionally, the base bottom 34 further comprises a recess/groove 96, the gasket top 74 further comprises a raised lip 98 seated inside the recess/groove 96, and the base bottom 34 further comprises a plurality of the aforementioned protrusions 92 extending laterally into the recess/groove 96 and into/engaging the raised lip 98 to secure the gasket 72 to the base 30, as best seen in FIGS. 7 and 7A. The protrusions 92 may be any suitable shape, including but not limited, to generally semi-circular.

Figure 2:
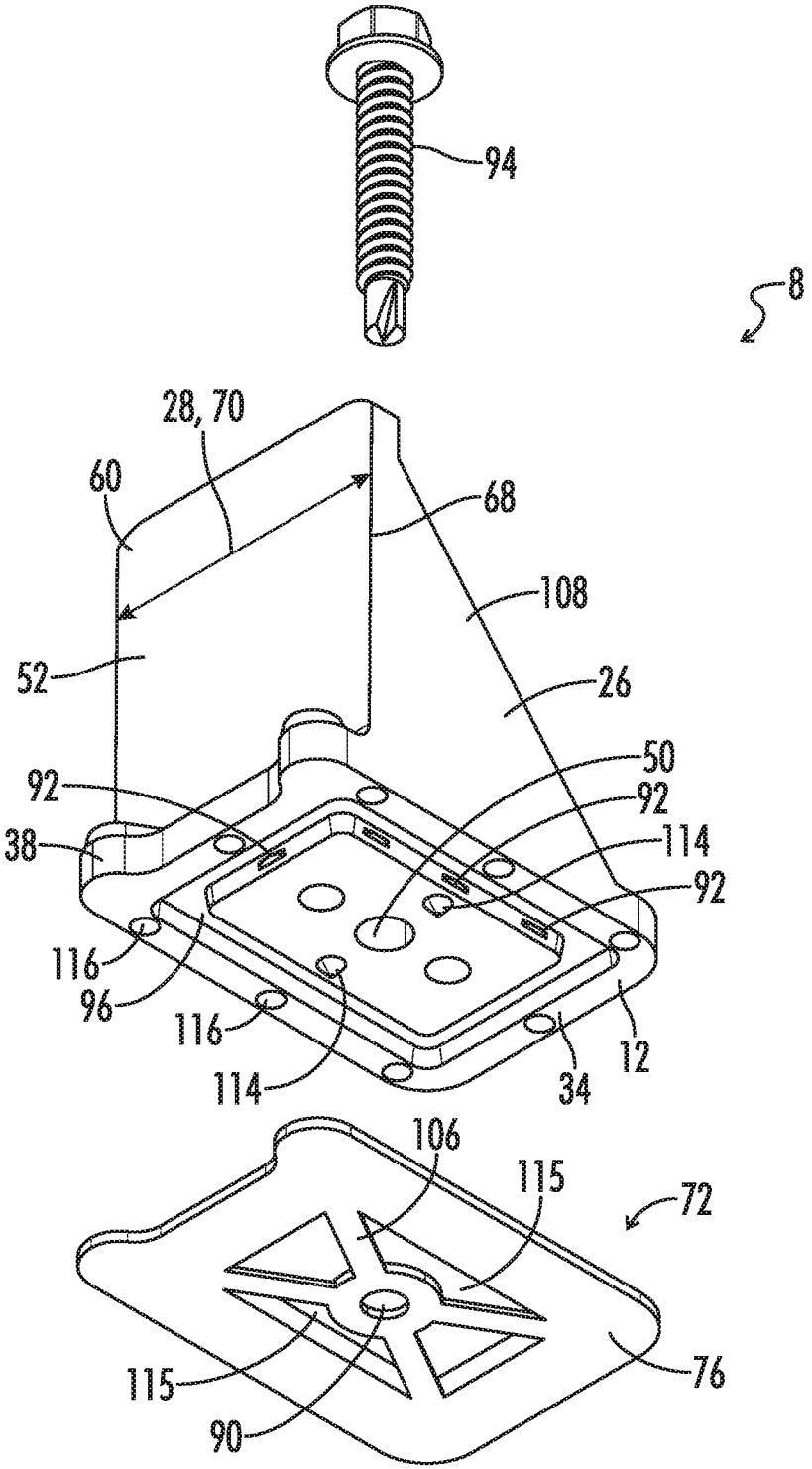
FIG. 2 illustrates a front exploded perspective view of the snowguard-gasket system of FIG. 1.

Optionally, as best seen in FIG. 1, the gasket 72 further comprises a cavity 104, the raised lip 98 of the gasket 72 forms a substantially closed perimeter bordering the cavity 104, the cavity 104 comprises a gasket rib 106 extending across the cavity 104 from one portion of the raised lip 98 to another portion of the raised lip 98, and the gasket fastener aperture 90 is located in the gasket rib 106. Optionally, the gasket rib 106 is an X-shaped pattern. Optionally, the recess/groove 96 and raised lip 98 are generally rectangular in shape. Optionally, some of the plurality of protrusions 92 extend laterally into the recess/groove 96 generally parallel to the base width 48 and some of the plurality of protrusions 92 extend laterally into the recess/groove 96 generally parallel to the base length 42, as best seen in FIG. 2, where the plurality of protrusions 92 are spaced about the recess/groove 96. In the exemplary embodiment of FIG. 2, the base 30 includes six lengthwise protrusions 92 (three of which are visible in FIG. 2) and two widthwise protrusions 92 (the top of which is visible in FIG. 2).

Figure 3A:
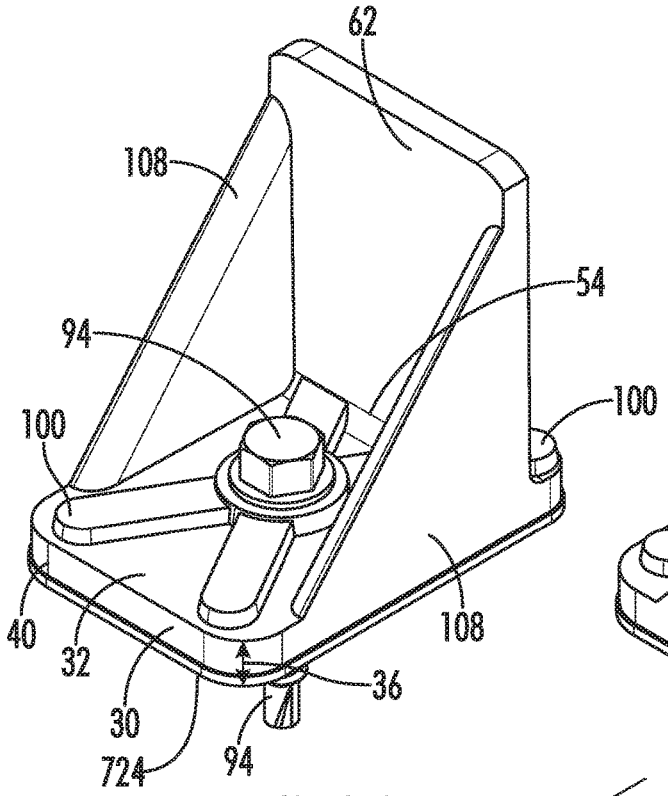
FIG. 3A illustrates a rear perspective view of the snowguard-gasket system of FIG. 1.
Figure 3B:
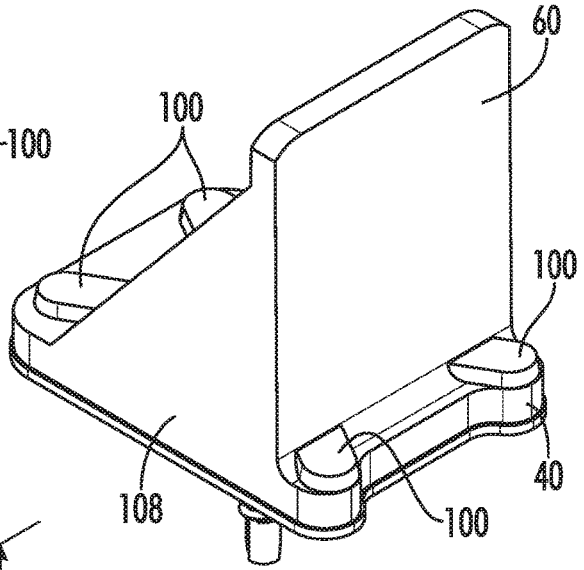
FIG. 3B illustrates a front perspective view of the snowguard-gasket system of FIG. 1.
Figure 4:
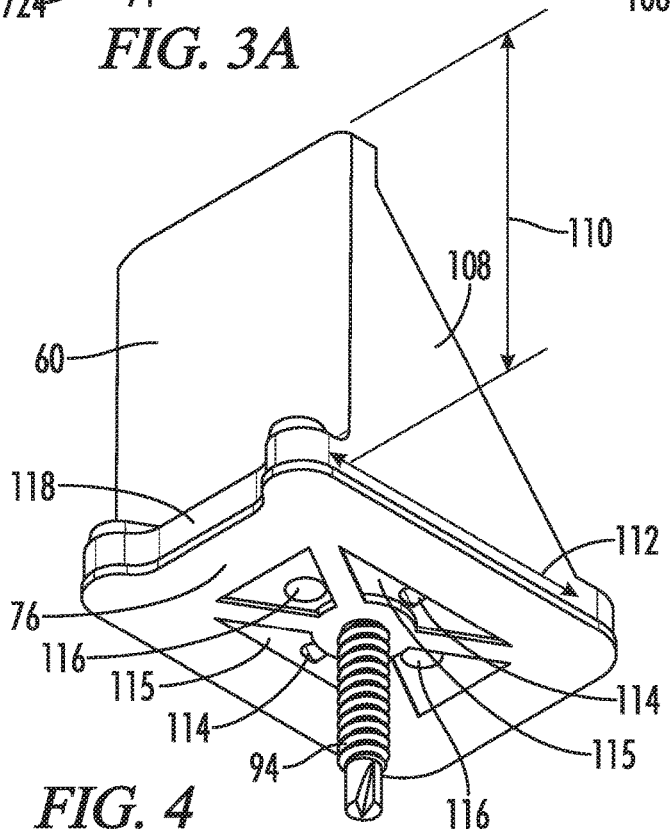
FIG. 4 illustrates another front perspective view of the snowguard-gasket system of FIG. 1.
Figure 5:
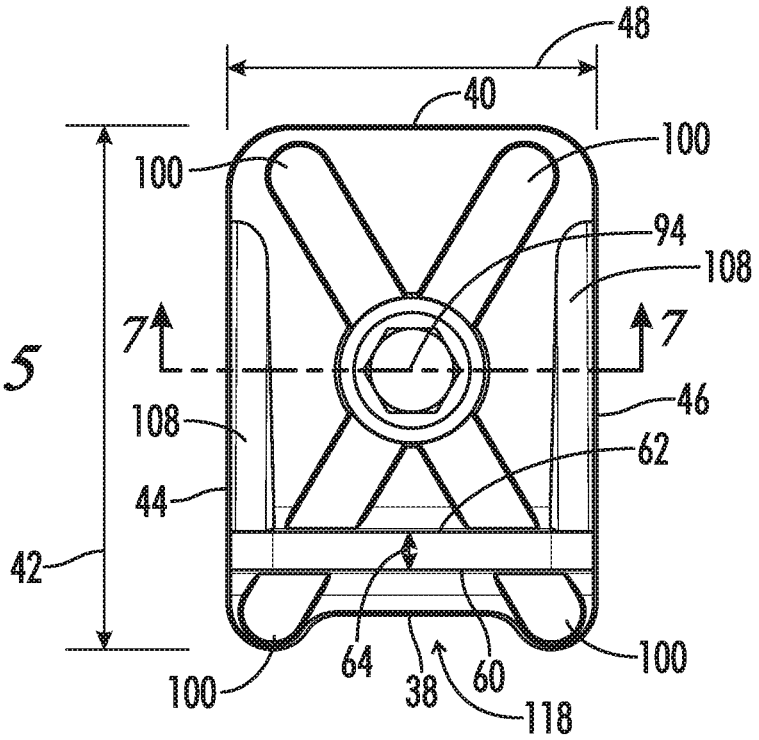
FIG. 5 illustrates a top plan view of the snowguard-gasket system of FIG. 1.
Figure 6:
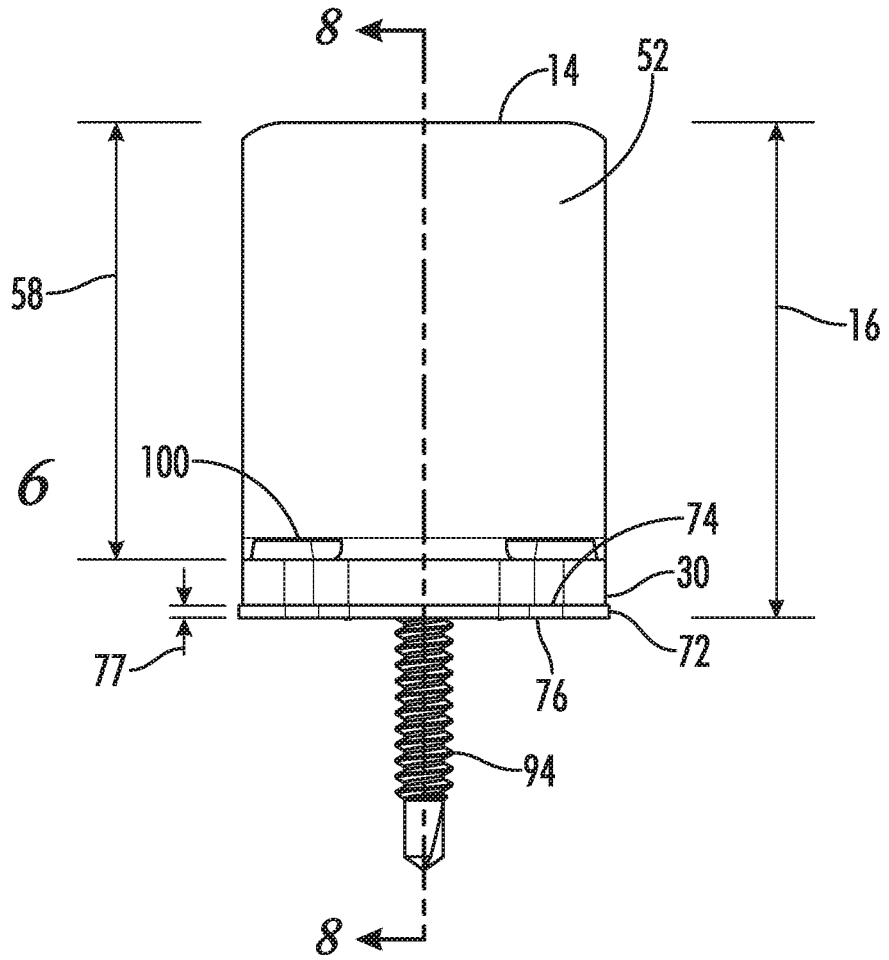
FIG. 6 illustrates a front elevation view of the snowguard-gasket system of FIG. 1.

Optionally, the base top 32 further comprises an external rib 100 located adjacent to the base fastener aperture 50, as seen in FIGS. 1, 3, and 5 for example. Optionally, as shown in FIGS. 3 and 5 the fastener 94 confronts the external rib 100. Without being bound by any particular theory, the external rib 100 may transfer the force of the fastener 94 to the perimeter of the base 30 to increase sealing power and also thereby displacing the force of the fastener 94 across the base 30. Optionally, the external rib 100 is integrally molded with the rest of the base 30. In other words, if the snowguard 10 is an injected molded piece, the external rib 100 may be integral with the rest of the snowguard 10, including the base 30, vertical faceplate 52 and brace(s) 108 described below. Optionally, the external rib 100 is an X-shaped pattern, as best seen in FIG. 5. Optionally, as best seen in FIG. 5, the base 30 is generally rectangular in shape and comprises four rounded corners and further wherein the X-shaped pattern comprises rounded ends. Optionally, as shown in FIG. 5, the base front 38 comprises an indendation 118 located between two rounded corners.

Optionally, the snowguard 10 further comprises one or more braces 108 extending from the base 30 to the face plate 52. Optionally, as shown in FIG. 1, for example, the brace(s) 108 extend from the base top 32 to the face plate rear 62). Optionally, the snowguard 10 further comprises two braces 108 extending from the base 30 to the face plate 52, the braces 108 are separated by a space, and the fastener aperture 50 is located in the space, as shown in FIG. 1 for example. Optionally, the external rib 100 is also located in the space, as shown in FIG. 1 for example. Optionally, the braces 108 are generally triangular in shape, as shown in FIG. 1 for example. Optionally, the braces 108 comprise a brace height 110 generally parallel to the snowguard height 16, the braces 108 comprise a brace length 112 generally parallel to the snowguard length 22, and one brace 108 is located adjacent to the base left side 44 and another brace 108 is located adjacent to the base right side 46, as shown in FIG. 1 for example.

Optionally, as best seen in FIGS. 2, 4, 7 and 7A, the base bottom 34 further comprises a conical protrusion 114 extending through the gasket 72 into the roof 78, which in addition to the fastener 94, secures the snowguard-gasket system 8 to the roof 78. Optionally, the base bottom 34 further comprises two conical protrusions 114 located on opposite sides of the base gasket fastener 90 extending through the gasket 72 into the roof 78. Optionally, the conical protrusion 114 extends into the roof 78 a distance of about 0.001 inches to about 0.1 inches. Optionally, the conical protrusion 114 extends through a gasket protrusion aperture 115 in the gasket 72. Preferably, as best seen in FIG. 7, the conical protrusion 114 extends downwardly beyond the gasket bottom 76 when the gasket bottom 76 is placed parallel to the ground. Optionally, the conical protrusion 114 comprises an apex 117, which may be pointed, flat (as best seen in FIG. 7A) or rounded, engaging the roof 78. Optionally, the face plate front 60 is generally flat and is configured to allow snow to rest against the face plate front 60. Optionally, in use, the gasket bottom 76 will mirror the angle of slope of the roof 78. Optionally, the conical protrusion 114 is in the shape of a truncated cone, as best seen in FIG. 7A.

Optionally, the snowguard 10 is injection-molded plastic. In some embodiments, the snowguard 10 and gasket 72 may both be clear. Optionally, the gasket 72 is comprised of low durometer PVC (polyvinyl chloride) or silicone. For example, in an exemplary embodiment, the gasket 72 is comprised of a PVC blend having a durometer in the range of about 60 to about 80 (shore 00).

Parts List

System 8
Snowguard 10
Snowguard bottom 12
Snowguard top 14
Snowguard height 16
Snowguard front 18
Snowguard rear 20
Snowguard length 22
Snowguard left side 24
Snowguard right side 26
Snowguard width 28
Horizontal snowguard base 30
Base top 32
Base bottom 34
Base height 36
Base front 38
Base rear 40
Base length 42
Base left side 44
Base right side 46
Base width 48
Base fastener aperture 50
Vertical face plate 52
Face plate bottom 54
Face plate top 56
Face plate height 58
Face plate front 60
Face plate rear 62
Face plate length 64

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed. Use of the singular embraces the plural.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A method of attaching a snowguard to a roof of a building comprising the steps of:

A) providing a snowguard-gasket system comprising:

i) a snowguard comprising a snowguard bottom, a snowguard top, a snowguard height extending from the snowguard bottom to the snowguard top, a snowguard front, a snowguard rear, a snowguard length extending from the snowguard front to the snowguard rear and generally perpendicular to the snowguard height, a snowguard left side, a snowguard right side, and a snowguard width extending from the snowguard left side to the snowguard right side and generally perpendicular to the snowguard height and length, the snowguard comprised of a) a horizontal snowguard base comprising a base top, a base bottom located at the snowguard bottom, a base height extending from the base top to the base bottom and generally parallel to the snowguard height, a base front, a base rear, a base length extending from the base front to the base rear and generally parallel to the snowguard length, a base left side, a base right side, and a base width extending from the base left side to the base right side, wherein the base further comprises a base fastener aperture extending through the base; and b) a vertical face plate extending upward from the snowguard base at an angle of approximately 90 degrees and comprising a face plate bottom, a face plate top, a face plate height extending from the face plate top to the face plate bottom and generally parallel to the snowguard height, a face plate front configured to block snow, a face plate rear, a face plate length extending from the face plate front to the face plate rear and generally parallel to the snowguard length, a face plate left side, a face plate right side, and a face plate width extending from the face plate left side to the face plate right side and generally parallel to the snowguard width;

ii) a gasket attached to the base bottom and comprising a gasket top confronting the base bottom, a gasket bottom configured to confront the roof of the building, a gasket height extending from the gasket top to the gasket bottom and generally parallel to the snowguard height, a gasket front, a gasket rear, a gasket length extending from the gasket front to the gasket rear and generally parallel to the snowguard length, a gasket left side, a gasket right side, a gasket width extending from the gasket left side to the gasket right side and generally parallel to the snowguard width, wherein the gasket further comprises a gasket fastener aperture aligned with the base aperture and extending through the gasket, wherein the gasket is comprised of a flexible material, wherein the base comprises at least one protrusion extending into the gasket and securing the gasket to the base bottom;

B) placing the gasket bottom against the roof of the building; and

C) securing the snowguard-gasket system to the roof by positioning a fastener so that the fastener extends through the base fastener aperture, through the gasket fastener aperture, and into the roof.

2. The method of claim 1 wherein the at least one protrusion deforms a portion of the gasket.

3. The method of claim 1 wherein the base bottom further comprises a groove, wherein the gasket top further comprises a raised lip seated inside the groove, and further wherein the base bottom further comprises a plurality of protrusions extending laterally into the groove and into the raised lip to secure the gasket to the base.

4. The method of claim 3 wherein the gasket further comprises a cavity, wherein the raised lip of the gasket forms a substantially closed perimeter bordering the cavity, wherein the cavity comprises a gasket rib extending across the cavity from one portion of the raised lip to another portion of the raised lip, and further wherein the gasket fastener aperture is located in the gasket rib.

5. The method of claim 4 wherein the gasket rib is an X-shaped pattern.

6. The method of claim 3 wherein some of the plurality of protrusions extend laterally into the groove generally parallel to the base width and some of the plurality of protrusions extend laterally into the groove generally parallel to the base length.

7. The method of claim 1 wherein the base top further comprises an external rib located adjacent to the base fastener aperture.

8. The method of claim 7 wherein the fastener confronts the external rib at least after step C).

9. The method of claim 8 wherein the external rib is an X-shaped pattern.

10. The method of claim 9 wherein the base is generally rectangular in shape and comprises four rounded corners and further wherein the X-shaped pattern comprises rounded ends, and further wherein the base front comprises an indentation located between two rounded corners.

11. The method of claim 1 wherein the snowguard further comprises at least one brace extending from the base to the face plate.

12. The method of claim 11 wherein the snowguard further comprises two braces extending from the base to the face plate, wherein the braces are separated by a space, and further wherein the fastener aperture is located in the sp ace.

13. The method of claim 12, wherein the base top further comprises an external rib located adjacent to the base fastener aperture, and further wherein the external rib is located in the space.

14. The method of claim 13 wherein the external rib is an X-shaped pattern.

15. The method of claim 12 wherein the braces are generally triangular in shape.

16. The method of claim 12 wherein the braces comprise a brace height generally parallel to the snowguard height, wherein the braces comprise a brace length generally parallel to the snowguard length, wherein one brace is located adjacent to the base left side and another brace is located adjacent to the base right side.

17. The method of claim 1 wherein the base bottom further comprises at least one generally conical protrusion extending through the gasket into the roof.

18. The method of claim 17 wherein the base bottom further comprises two generally conical protrusions located on opposite sides of the fastener extending through the gasket into the roof.

19. The method of claim 17 wherein the at least one generally conical protrusion extends beyond the gasket bottom and into the roof a distance of about 0.001 inches to about 0.1 inches.

20. The method of claim 1 wherein the face plate front is generally flat.

21. The method of claim 1 further comprising the step of resting snow against the face plate front.

* * * * *